US009348255B2

(12) United States Patent
Kanai et al.

(10) Patent No.: US 9,348,255 B2
(45) Date of Patent: May 24, 2016

(54) LAYER THICKNESS REGULATING MEMBER, DEVELOPING DEVICE AND PROCESS CARTRIDGE

(71) Applicant: CANON KABUSHIKI KAISHA, Tokyo (JP)

(72) Inventors: Dai Kanai, Abiko (JP); Takeshi Yasumoto, Abiko (JP); Koichi Watanabe, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/451,640

(22) Filed: Aug. 5, 2014

(65) Prior Publication Data

US 2015/0043948 A1 Feb. 12, 2015

(30) Foreign Application Priority Data

Aug. 9, 2013 (JP) ..... 2013-166636

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01); *G03G 2221/183* (2013.01)

(58) Field of Classification Search
CPC ..... G03G 15/0812
USPC ..... 399/274, 284
See application file for complete search history.

(56) References Cited

U.S. PATENT DOCUMENTS 4,556,307 A * 12/1985 Jensen
4,695,153 A * 9/1987 Matsushita ..... 399/274
4,917,043 A * 4/1990 Yokoyama
5,038,176 A * 8/1991 Yokoyama et al.
5,212,525 A * 5/1993 Noami et al.
5,475,467 A 12/1995 Watanabe et al.
5,697,021 A 12/1997 Watanabe et al.

(Continued)

FOREIGN PATENT DOCUMENTS

JP 11311901 A * 11/1999
JP 2001-255739 A 9/2001
JP 2002-214886 A 7/2002

(Continued)

OTHER PUBLICATIONS

Koichi Watanabe, U.S. Appl. No. 14/483,391, filed Sep. 11, 2014.
Takeshi Yasumoto, U.S. Appl. No. 14/340,746, filed Jul. 25, 2014.

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

A layer thickness regulating member regulates an amount of developer carried on a surface of a developer carrying member and includes a base portion and a layer thickness regulating portion. The base portion includes an upstream base portion and a downstream base portion. A reinforcing rib portion projects from a rear side of the base portion and includes a first reinforcing rib and a second reinforcing rib disposed in a direction crossing the first reinforcing rib. The base portion, the layer thickness regulating portion, and the reinforcing rib portion are integrally molded. The layer thickness regulating portion and the first reinforcing rib are provided at positions spaced from each other with respect to a tangential direction of the developer carrying member.

11 Claims, 8 Drawing Sheets

(56) References Cited

U.S. PATENT DOCUMENTS

| | | | | |
|---|---|---|---|---|
| 6,606,469 | B2 | 8/2003 | Kikuchi et al. | |
| 7,043,182 | B2 * | 5/2006 | Sakai et al. | 399/284 |
| 2008/0298848 | A1 * | 12/2008 | Lee | 399/274 |
| 2014/0255061 | A1 | 9/2014 | Yasumoto et al. | |

FOREIGN PATENT DOCUMENTS

| | | | | | |
|---|---|---|---|---|---|
| JP | 2004-086213 | A | | 3/2004 | |
| JP | 2004184941 | A | * | 7/2004 | |
| JP | 2012-247757 | A | | 12/2012 | |
| WO | WO 2013094167 | A1 | * | 6/2013 | G03G 15/0812 |

* cited by examiner (a)

(b)

(a)

(b)

LAYER THICKNESS REGULATING MEMBER, DEVELOPING DEVICE AND PROCESS CARTRIDGE

FIELD OF THE INVENTION AND RELATED ART

The present invention relates to a layer thickness regulating member for regulating a layer thickness of a developer carried on a developer carrying member, and specifically relates to the layer thickness regulating member provided with a reinforcing rib with respect to an axis direction of the developer carrying member. The present invention further relates to a developing device and a process cartridge which include the layer thickness regulating member.

An image forming apparatus in which an electrostatic image formed on an image bearing member is developed by a developing device to form a toner image and then the formed toner image is transferred onto a recording material and is heated and pressed by a fixing device to form an image on the recording material has been widely used. The developing device regulates, by a layer thickness regulating member, the developer carried on a rotating developer carrying member to carry the developer in a predetermined uniform thickness on the developer carrying member (Japanese Laid-Open Patent Application (JP-A) 2002-214886 and JP-A 2012-247757).

In a developing device in JP-A 2012-247757, a layer thickness regulating member (doctor blade) which is a thin metal plate is fixed to a resin-made beam member extended in a beam shape between a pair of supporting members is rotatably supporting the developer carrying member at both ends of the developer carrying member. A resin-made layer thickness regulating member is fixed with screws to the beam member in a state in which the layer thickness regulating member is positioned so that a predetermined gap is formed between a free end portion of the layer thickness regulating member and the developer carrying member.

In the developing device in JP-A 2012-247757, the layer thickness regulating member and the beam member for supporting the layer thickness regulating member are provided as separate members, and therefore a component cost is expensive. In a state in which the layer thickness regulating member is positioned so as to form a predetermined gap with the developer carrying member, the layer thickness regulating member is fixed on the beam member with the screws at a plurality of positions, and therefore an assembling cost is expensive.

For this reason, a constitution in which a layer thickness regulating portion functioning as the layer thickness regulating member and the beam member are integrally formed of a resin material to prepare a single layer thickness regulating member was proposed. Specifically, the constitution in which the layer thickness regulating portion is disposed in a side, toward the developer carrying member, of an opposing portion opposing a peripheral surface of the developer carrying member and in which a lattice-like reinforcing rib portion is provided in a side, opposite from the developer carrying member, of the layer thickness regulating portion was proposed. However, in actuality, when the layer thickness regulating member prepared by integrally molding the opposing portion, the layer thickness regulating portion and the lattice-like reinforcing rib portion was prototyped, the layer thickness regulating member caused distortion, so that it was turned out that a thickness of the developer carried on the developer carrying member partly increased at an overlapping position between the layer thickness regulating portion and the lattice-like reinforcing rib portion in front and back (rear) sides of the layer thickness regulating member.

SUMMARY OF THE INVENTION

A principal object of the present invention is to provide a layer thickness regulating member, capable of preventing a partial increase in layer thickness of a developer carried on a developer carrying member even when an opposing portion, a layer thickness regulating portion and a rib portion are integrally molded.

Another object of the present invention is to provide a developing device and a process cartridge in which the layer thickness regulating member is incorporated.

According to an aspect of the present invention, there is provided a layer thickness regulating member comprising: an opposing portion opposing a peripheral surface of a developer carrying member; a layer thickness regulating portion, projecting from the opposing portion toward the developer carrying member, for regulating a layer thickness of a developer carried on the developer carrying member; and a rib portion provided in a side, of the opposing portion, opposite from the layer thickness regulating portion, wherein the opposing portion, the layer thickness regulating portion and the rib portion are integrally molded, and wherein the rib portion is disposed at a non-overlapping position with a region, at least in an image forming region, corresponding to a region where the layer thickness regulating portion is formed at the opposing portion.

According to another aspect of the present invention, there is provided a layer thickness regulating member comprising: an opposing portion opposing a peripheral surface of a developer carrying member; a layer thickness regulating portion, projecting from the opposing portion toward the developer carrying member, for regulating a layer thickness of a developer carried on the developer carrying member; and a first rib portion provided in a side, of the opposing portion, opposite from the layer thickness regulating portion, wherein the opposing portion, the layer thickness regulating portion, the first rib portion and the second rib portion are integrally molded, wherein the first rib portion is continuously disposed with respect to a rotational axis direction of the developer carrying member at a non-overlapping position with a region, at least in an image forming region, corresponding to a region where the layer thickness regulating portion is formed at the opposing portion, and a second rib portion which is provided in the side opposite from the layer thickness regulating portion projecting from the opposing portion and which is disposed with respect to a direction crossing the first rib portion so as to be connected with the first rib portion; wherein the second rib portion has a thickness, when the second rib portion overlaps with the region where the layer thickness regulating portion is formed, which is ½ or less of a length of the layer thickness regulating portion with respect to the rotational axis direction of the developer carrying member at an overlapping position with the region where the layer thickness regulating portion is formed.

According to another aspect of the present invention, there is provided a developing device comprising: the layer thickness regulating member described above; and a developer carrying member opposing the layer thickness regulating member at a peripheral surface thereof, wherein a pair of supporting portions for rotatably supporting ends of the developer carrying member are fixed to end portions of the layer thickness regulating member.

According to a further aspect of the present invention, there is provided a process cartridge comprising: the developing device described above; an image bearing member for bearing an electrostatic image to be developed into a toner image by the developing device; and a positioning structure for positioning the developer carrying member of the developing device at a position spaced from the image bearing member by a predetermined gap.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings.

(Image Forming Apparatus)

Figure 1:
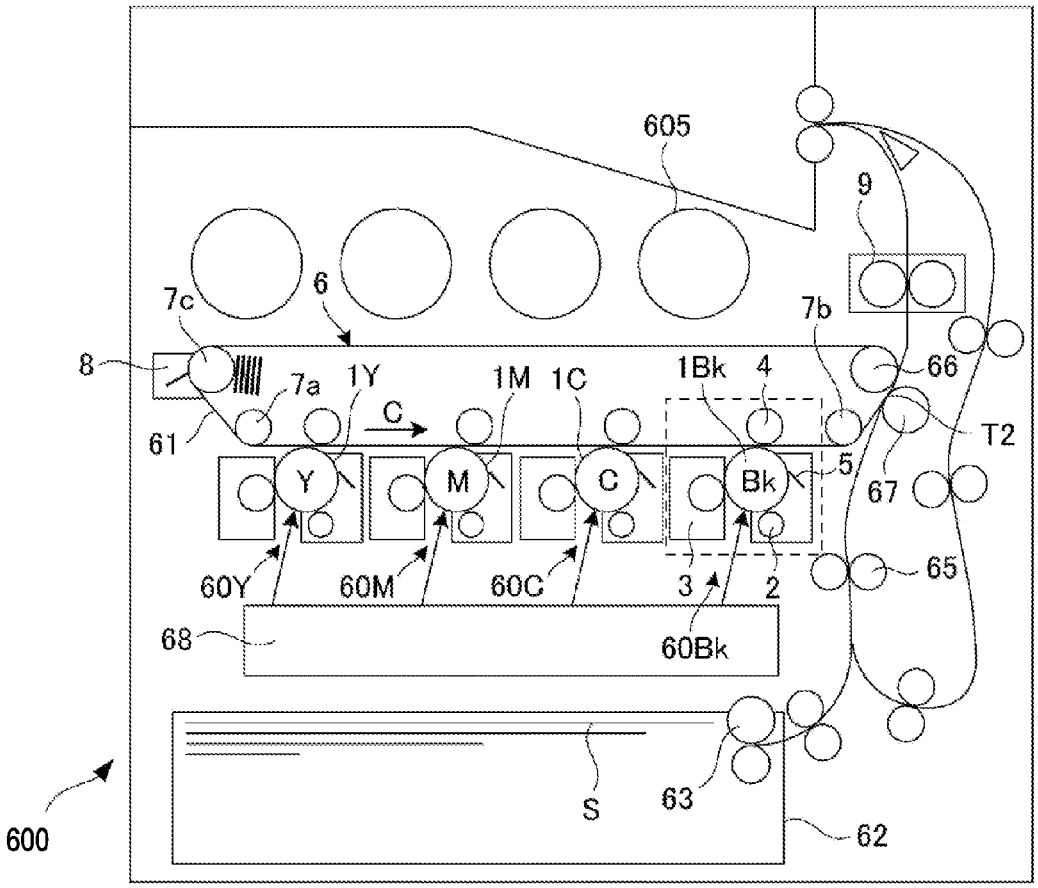
FIG. 1 is an illustration of a structure of an image forming apparatus.

FIG. 1 is an illustration of a structure of an image forming apparatus 600. As shown in FIG. 1, the image forming apparatus 600 is an intermediary transfer type full color printer of a tandem type in which image forming portions 60Y, 60M, 60C and 60Bk are arranged along a downward surface of an intermediary transfer belt 61.

At the image forming portion 60Y, a yellow toner image is formed on a photosensitive drum 1Y and then is transferred onto the intermediary transfer belt 61. At the image forming portion 60M, a magenta toner image is formed on a photosensitive drum 1M and then is transferred onto the intermediary transfer belt 61. At the image forming portions 60C and 60Bk, cyan and black toner images are formed on photosensitive drums 1C and 1Bk, respectively, and then are transferred onto the intermediary transfer belt 61.

The four color toner images transferred on the intermediary transfer belt 61 are conveyed to a secondary transfer portion T2 and are secondary-transferred onto the recording material S. A separation roller 63 separates sheets of the recording material S, one by one, pulled out from a recording material cassette 62, and then feeds the recording material S to a registration roller pair 65. The registration roller pair 65 sends the recording material S to the secondary transfer portion T2 while being timed to the toner images on the intermediary transfer belt 61. The recording material P on which the four color toner images are secondary-transferred is pressed and heated by a fixing device 9, so that the toner images are fixed on a surface of the recording material S.

(Image Forming Portion)

The image forming portions 60Y, 60M, 60C and 60Bk have the substantially same constitution except that colors of toners used in developing devices 3 are yellow, magenta, cyan and black, respectively, which are different from each other. In the following, the image forming portion 60Bk is described, and redundant explanation about other image forming portions 60Y, 60M and 60C will be omitted.

The image forming portion 60Bk includes, at a periphery of the photosensitive drum 1Bk, a charging device 2, an exposure device 68, the developing device 3, a transfer roller 4 and a drum cleaning device 5. The photosensitive drum 1Bk is prepared by forming a photosensitive layer on an outer peripheral surface of an aluminum cylinder, and is rotated at a predetermined process speed.

The charging device 2 electrically charges a surface of the photosensitive drum 1Bk to a negative potential uniformly by applying, to a charging roller, an oscillating voltage in the form of a negative(−polarity) DC voltage biased with an AC voltage. The exposure device 68 scans the surface of the photosensitive drum 1K with a laser beam, obtained by ON-OFF modulation of a scanning line image signal developed from an associated color image, through a rotating mirror, so that an electrostatic image for an image is written (formed) on the surface of the photosensitive drum 1Bk. The developing device 3 develops the electrostatic image into a toner image by transferring the toner onto the photosensitive drum 1Bk. A fresh toner in an amount corresponding to an amount of the toner consumed in the developing device 3 by image formation is supplied from a toner cartridge 605 to the developing device 3 via an unshown toner feeding path.

The transfer roller 4 presses the intermediary transfer belt 61 to form a transfer portion between the photosensitive drum 1Bk and the intermediary transfer belt 61. By applying a positive DC voltage to the transfer roller 4, the negative toner image carried on the photosensitive drum 1Bk is transferred onto the intermediary transfer belt 61. The drum cleaning device 5 removes a transfer residual toner deposited on the surface of the photosensitive drum 1Bk by sliding a cleaning blade on the surface of the photosensitive drum 1Bk.

The intermediary transfer belt 61 is extended around and supported by a tension roller 7*c*, a driving roller 66 also functioning as a secondary transfer opposite roller, and stretching rollers 7*a* and 7*b*, and is driven by the driving roller 66 to be rotated in an arrow C direction. A secondary transfer roller 67 contacts the intermediary transfer belt 61 supported at an inside surface thereof by the driving roller 66 to form the secondary transfer portion T2. By applying a positive DC voltage to the secondary transfer roller 67, the toner image on the intermediary transfer belt 61 is transferred onto the recording material S. A belt cleaning device 8 collects the transfer residual toner on the surface of the intermediary transfer belt 61 by rubbing the intermediary transfer belt 61 with a cleaning blade.

Embodiment 1

Figure 2:
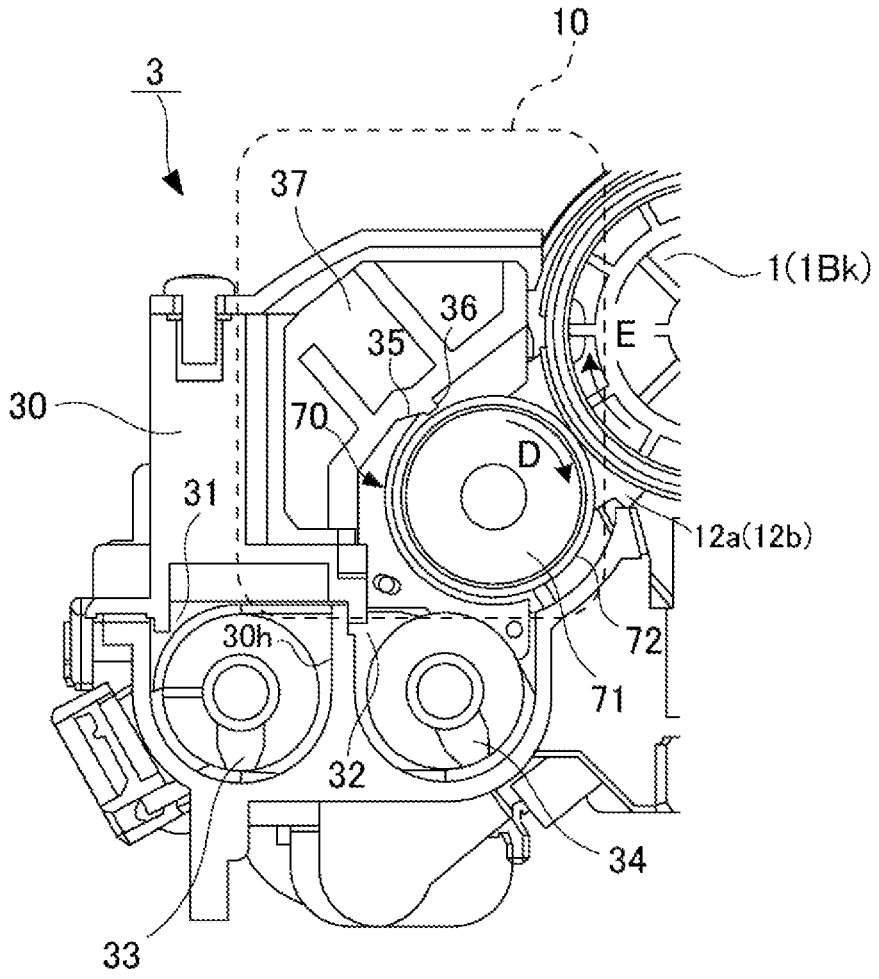
FIG. 2 is an illustration of a structure of a developing device in Embodiment 1.

As shown in FIG. 2, abutting portions 12*a* and 12*b* as an example of a positioning structure position a developing sleeve 70 of the developing device 3 relative to the photosensitive drum 1Bk as an example of an image bearing member at a position spaced from the photosensitive drum 1Bk with a predetermined gap (spacing).

Figure 3:
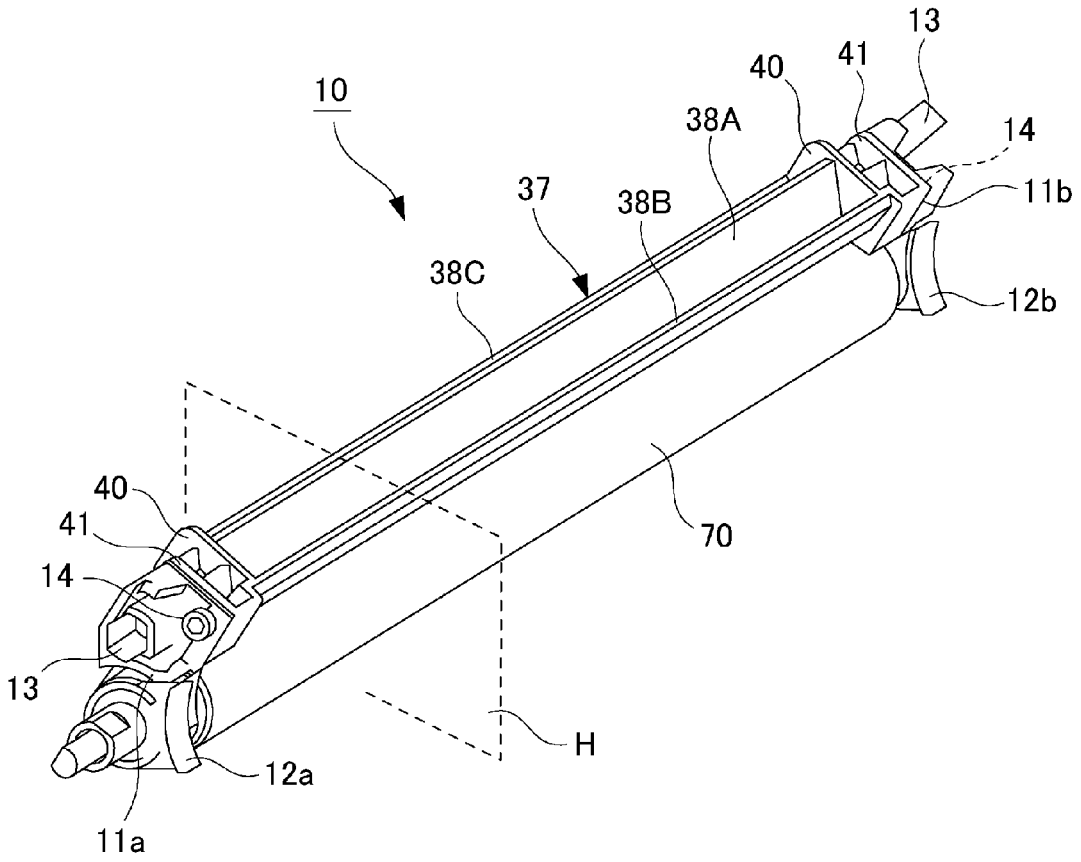
FIG. 3 is a perspective view of a developing sleeve holder unit in Embodiment 1.

As shown in FIG. 3, in the developing device 3, the developing sleeve 70 is provided so as to oppose a layer thickness regulating portion 36 of a sleeve holder frame 37 at a peripheral surface thereof. Sleeve bearing members 11*a* and 11*b* as an example of a pair of supporting portions are fixed to both end portions of the sleeve holder frame 37 and rotatably support the developing sleeve 70 at both ends of the developing sleeve 70. The sleeve bearing members 11*a* and 11*b* are fixed on end surfaces of the sleeve holder frame 37 after adjusting a gap between a layer thickness regulating portion 36 and the developing sleeve 70 at a predetermined distance.

The sleeve holder frame 37 as an example of a layer thickness regulating member is prepared by integrally molding a developer rectifying portion 35, a cover portion 37C, the layer thickness regulating portion 36 and a rib portion 38A by injection molding using a non-magnetic resin material as an example of a resin material.

Each of the developer rectifying portion 35 and the cover portion 37C which are examples of opposing portions opposes the peripheral surface of the developing sleeve 70 as an example of the developer carrying member. The developer rectifying portion 35 as an example of an upstream position opposes a region where the developing sleeve 70 enters the layer thickness regulating portion 36 from the developer rectifying portion. The cover portion 37C as an example of a downstream opposing portion opposes a region where the developing sleeve 70 passes through the layer thickness regulating portion 36. The layer thickness regulating portion 36 as an example of a layer thickness regulating portion projects from the developer rectifying portion 35 toward the developing sleeve 70 side as an example of a developer carrying member side and regulates a layer thickness of the developer carried on the developing sleeve 70.

(Process Cartridge)

As shown in FIG. 1, each of the image forming portions 60Y, 60M, 60C and 60Bk is prepared by integrally assembling portions excluding the exposure device 68 and the transfer roller 4 into a unit as a process cartridge which is an exchanging (replacing) unit for associated one of the colors. Each of the image forming portions 60Y, 60M, 60C and 60Bk is detachably mounted to an apparatus main assembly frame of the image forming apparatus 600. The transfer roller 4 is incorporated in an intermediary transfer unit 6 including the intermediary transfer belt 61. The process cartridge is prepared by integrally assembling the image forming portion 60Bk including the developing device 3 into a unit, and is detachably mountable to the image forming apparatus 600.

Incidentally, depending on some image forming apparatus, there is also the case where the drum cleaning device 5 is provided as an independent exchanging unit. There is also the case where the drum cleaning device 5 and the charging device are provided as an independent exchanging unit, and the photosensitive drum 1Bk and the developing device 3 are provided as a single process cartridge.

(Developing Device)

FIG. 2 is an illustration of a structure of the developing device 3 in Embodiment 1. As shown in FIG. 2, in the developing device 3, a two-component developer containing a (non-magnetic) toner and a (magnetic) carrier in mixture is stored in the developing container 30. The developing device 3 electrically charges the developer stored in the developing container 30, and then supplies the toner to the electrostatic image on the photosensitive drum 1Bk while carrying the charged developer on the surface of the developing sleeve 70.

The developing device 3 includes the developing sleeve 70 at an opening toward the photosensitive drum 1Bk. Below the developing sleeve 70, a first feeding screw 33 and a second feeding screw 34 are provided. The developing sleeve 70 and the first and second feeding screws 33 and 34 are rotationally driven integrally by being connected with gear trains provided at associated shaft ends outside the developing container 30.

The developing container 30 is partitioned into a first feeding chamber 31 and a second feeding chamber 32 by a partition wall 30*h*. The first and second feeding chambers 31 and 32 communicate with each other through an opening, of the partition wall 30*h*, formed at each of longitudinal end portions of the partition wall 30*h*. The first feeding screw 33 is disposed in the first feeding chamber 31, and the second feeding screw 34 is disposed in the second feeding chamber 32. By driving the first and second feeding screws 33 and 34, the developer is delivered through the openings of the partition wall 30*h*, so that the developer is circulated between the first and second feeding chambers 31 and 32. In a process in which the developer is fed while being stirred by the first and second feeding screws 33 and 34, the carrier and the toner in the developer are triboelectrically charged to the positive polarity and the negative polarity, respectively.

The developing sleeve 70 supports rotatably only a sleeve pipe 72 around a magnet portion 71 supported non-rotatably by the developing container 30. The sleeve pipe 72 constitutes an outer shell of the developing sleeve 70. The sleeve pipe 72 opposes the second feeding screw 34 in the developing container 30 with respect to a circumferential direction. The second feeding screw 34 supplies the developer to the developing sleeve 70 while feeding the developer in the second feeding chamber 32. The supplied developer is carried on the surface of the developing sleeve 70 by a magnetic force of the magnet portion 71 and is fed in an arrow D direction.

The magnet portion 71 generates a magnetic field for magnetically carrying the developer on the surface of the rotating developing sleeve 70. Magnetic poles of the magnet portion 71 are fixed at predetermined phase positions with respect to the circumferential direction and are supported non-rotatably, and therefore magnetic pole patterns formed on the surface of the developing sleeve 70 are fixed at predetermined phases with respect to the circumferential direction.

The developing sleeve 70 opposes the second feeding screw 34, the developer rectifying portion 35, the layer thickness regulating portion 36 and the photosensitive drum 1 in the listed order along the rotational direction thereof. The developer rectifying portion 35 constitutes a guide when the developing sleeve 70 rotating in the arrow D direction feeds the developer.

The carrier and the toner in the developer are carried in an erected chain shape on the surface of the developing sleeve 70 in a deposited state by triboelectric charge at associated magnetic polarity positions of the magnet portion 71. The developer carried on the developing sleeve 70 passes through the developer rectifying portion 35, and then the layer thickness of the developer is regulated by the layer thickness regulating portion 36. Stagnation of the developer is formed in a space defined by the developer rectifying portion 35 and the developing sleeve 70 in front of the layer thickness layer thickness regulating portion 36, so that a density of the developer with respect to the rotational axis direction of the developing sleeve 70 is uniformized.

The layer thickness regulating member (sleeve holder frame) 37 causes a free end of the layer thickness regulating portion 36 to oppose the surface of the developing sleeve 70. The developer erected in a chain shape by the magnetic field of the developing sleeve 70 is fed toward the layer thickness regulating portion 36. A gap between the free end surface of the layer thickness regulating portion 36 and the surface of the developing sleeve 70 is set in a desired range, and therefore the erected chain-shaped developer forms a uniform thickness coating layer by passing through the layer thickness regulating portion 36.

An opposing distance between the developing sleeve 70 and the photosensitive drum 1 is set at a predetermined value (300 μm) by abutment portions 12*a* and 12*b* formed on the sleeve bearing members 11*a* and 11*b* (FIG. 3) for supporting the rotation shaft of the developing sleeve 70. The opposing distance between the developing sleeve 70 and the photosensitive drum 1 is referred to as SD gap. The electrostatic image on the photosensitive drum 1 is developed by the magnetic chain rubbing the surface of the photosensitive drum 1 in a height exceeding the SD gap. The rotational direction D of the developing sleeve 70 is set as a counter direction to the rotational direction E of the photosensitive drum 1, but may also be the same direction as the rotational direction at the opposing portion.

(Sleeve Holder Unit)

Figure 4:
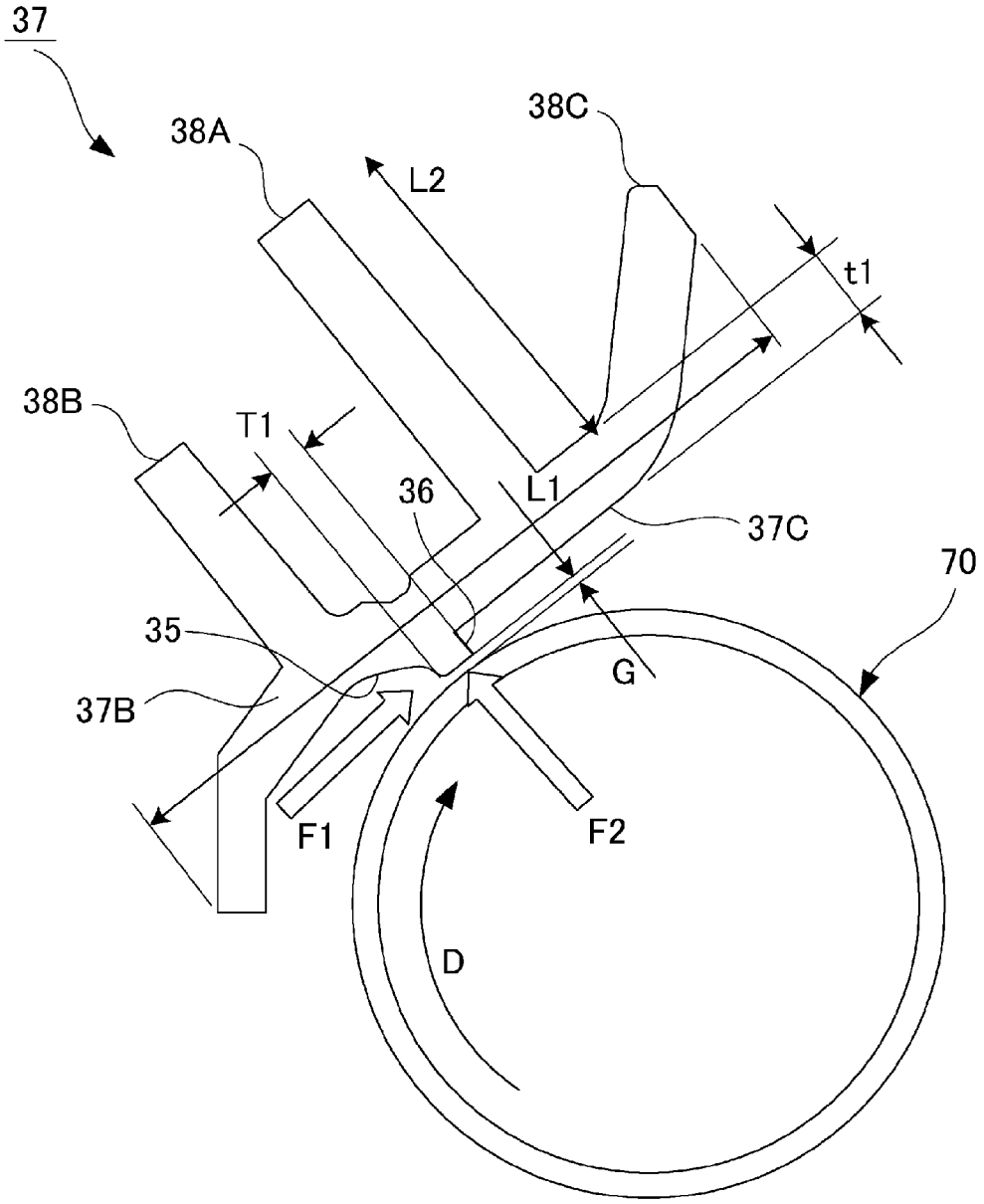
FIG. 4 is a sectional view of a sleeve holder frame in cross section perpendicular to a shaft of a developing sleeve.

FIG. 3 is a perspective view of the sleeve holder unit 10 in this embodiment. FIG. 4 is a sectional view of the sleeve holder frame 37 in cross section perpendicular to a shaft (axis) of the developing sleeve 70. FIG. 4 shows an arrangement relationship between the sleeve holder frame 37 (the developer rectifying portion 35 and the layer thickness regulating portion 36) and the developing sleeve 70 in a cross-section H shown in FIG. 3.

As shown in FIG. 3, a sleeve holder unit 10 is an exchanging unit prepared by integrally assembling the developing sleeve 70, the sleeve bearing members 11*a* and 11*b* and the sleeve holder frame 37 into a unit. The sleeve holder unit 10 is disposed in a beam shape by being extended between the pair of sleeve bearing members 11*a* and 11*b*.

In the sleeve holder unit 10, the sleeve bearing members 11*a* and 11*b* are fixed to both end portions of the sleeve holder frame 37.

The developing sleeve 70 is supported rotatably by the sleeve bearing members 11*a* and 11*b*. Cylindrical shafts projecting from ends of the developing sleeve 70 are inserted into bearings (sintered bearings) engaged in the sleeve bearing members 11*a* and 11*b*.

As shown in FIG. 3, the sleeve holder unit 10 is held at position and an attitude in the developing container shown in FIG. 2 by a pair of developing shafts 13 of the sleeve bearing members 11*a* and 11*b*. The developing shafts 13 swingably support the developing sleeve 70 relative to the developing container 30, and at the same time, do not prevent thermal expansion and contraction of the sleeve holder frame 37 by movably supporting the developing sleeve 70 in a rotational axis direction of the developing sleeve 70.

As shown in FIG. 4, an SB gap G is formed between the layer thickness regulating portion 36 and the closest portion of the developing sleeve 70. The SB gap G is defined at a free end portion of the layer thickness regulating portion 36, and in order to obtain an optimum developed image density, there is a need to ensure accuracy at a level of about 300 μm±30-50 μm in an entire area of a developing region on the developing sleeve 70. In order to uniformize a developer coating amount over the entire area of the developing region on the developing sleeve 70, straightness of a regulating surface of the layer thickness regulating portion 36 may preferably be 30 μm or less.

For that reason, adjustment of the SB gap G is made by moving the position of the sleeve holder frame 37, as a whole, relative to the sleeve bearing members 11*a* and 11*b*.

The sleeve holder frame 37 is extended in a beam shape between the pair of sleeve bearing members 11*a* and 11*b*. The sleeve bearing members 11*a* and 11*b* are fixed at the end surfaces of the sleeve holder frame 37 after adjusting an SB gap where the layer thickness regulating portion 36 (FIG. 2) and the developing sleeve 70 oppose each other.

In this embodiment, in a state in which an SB gap value falling within a desired range is confirmed by a TV camera or the like, screws 14 are passed through through-holes of the sleeve bearing members 11*a* and 11*b* to fasten the sleeve bearing members 11*a* and 11*b* to female screws of the sleeve holder frame 37. The sleeve bearing members 11*a* and 11*b* are fixed to the sleeve holder frame 37 by the screws 14, thus assembling integrally the sleeve holder unit as a whole.

However, in the case where the sleeve holder frame 37 and the sleeve bearing members 11*a* and 11*b* are formed of the resin material, it is desirable that laser welding or UV bending is employed as a fixing method of the sleeve holder frame 37 and the sleeve bearing members 11*a* and 11*b*. This is because compared with the screws 14 or the like, the laser welding or the UV bonding is capable of suppressing a degree of torsional deformation between the members with the fixing to a small amount.

(Sleeve Holder Frame)

As shown in FIG. 3, the sleeve holder frame 37 constitutes a part of a double housing type structure for holding end portions of the developing sleeve 70. The sleeve holder frame 37 is a single component formed integrally by injection molding with a thermoplastic resin material.

As shown in FIG. 4, the sleeve holder frame 37 requires sufficient rigidity against a force generated when a developer coating amount on the surface of the developing sleeve 70 is made uniform in the SB gap G. During image formation, the developer carried on the developing sleeve 70 runs against the layer thickness regulating portion 36 and then passes through the SB gap G while being subjected to pressure application from the layer thickness regulating portion 36. The layer thickness regulating portion 36 is subjected to application of a force F1 with respect to a developer feeding direction and a tangential direction of the developing sleeve 70 and a force F2, with respect to a normal direction, passing from an axial center of the developing sleeve 70 toward the layer thickness regulating portion 36.

For this reason, the sleeve holder frame 37 has a cross-sectional shape having a length L1 with respect to the substantially same direction as the force F1 direction in order to obtain the rigidity against the force F1 in the tangential direction. Further, the sleeve holder frame 37 includes the reinforcing rib 38A having a length L2 with respect to the substantially source direction as the force F2 direction in order to obtain the rigidity against the force F2 in the normal direction.

The developer rectifying portion 35 and the layer thickness regulating portion 36 of the sleeve holder frame 37 constitute a flow path wall surface of a developer flow path formed between the sleeve holder frame 37 and the developing sleeve 70. In a back side of the flow path wall surface of the sleeve holder frame 37, the reinforcing ribs 38A, 38B and 38C for reducing a degree of the deformation of the layer thickness regulating portion 36 are disposed. The sleeve holder frame 37 is provided with reinforcing ribs 38A, 38B and 38C in a side opposite from a side where the sleeve holder frame 37 opposes the developing sleeve 70.

The sleeve holder frame 37 is provided with the layer thickness regulating portion 36, the developer rectifying portion 35 and a cover portion 37C in the side where the base surface 37B formed in a base thickness t1 opposes the developing sleeve 70. The base surface 37B, the layer thickness regulating portion 36, the reinforcing ribs (reinforcing rib portions) 38A, 38B and 38C are integrally constituted in the cross-section, of the sleeve holder frame, perpendicular to the developing sleeve axis. As the resin material used for the sleeve holder frame 37, a material, having relatively high rigidity, such as PC+AS resin material or PC+ABS resin material is selected.

The sleeve holder frame 37 ensures large geometrical moment of inertia required against the forces F1 and F2 by integrally constituting the developer rectifying portion 35, the layer thickness regulating portion 36 and the reinforcing ribs 38A, 38B and 38C. Warpage and flexure against a resultant force of the forces F1 and F2 are kept in an allowable range, so that a fluctuation in distribution of the SB gap G along the developing sleeve 70 is obviated.

Comparison Example 1

Figure 5:
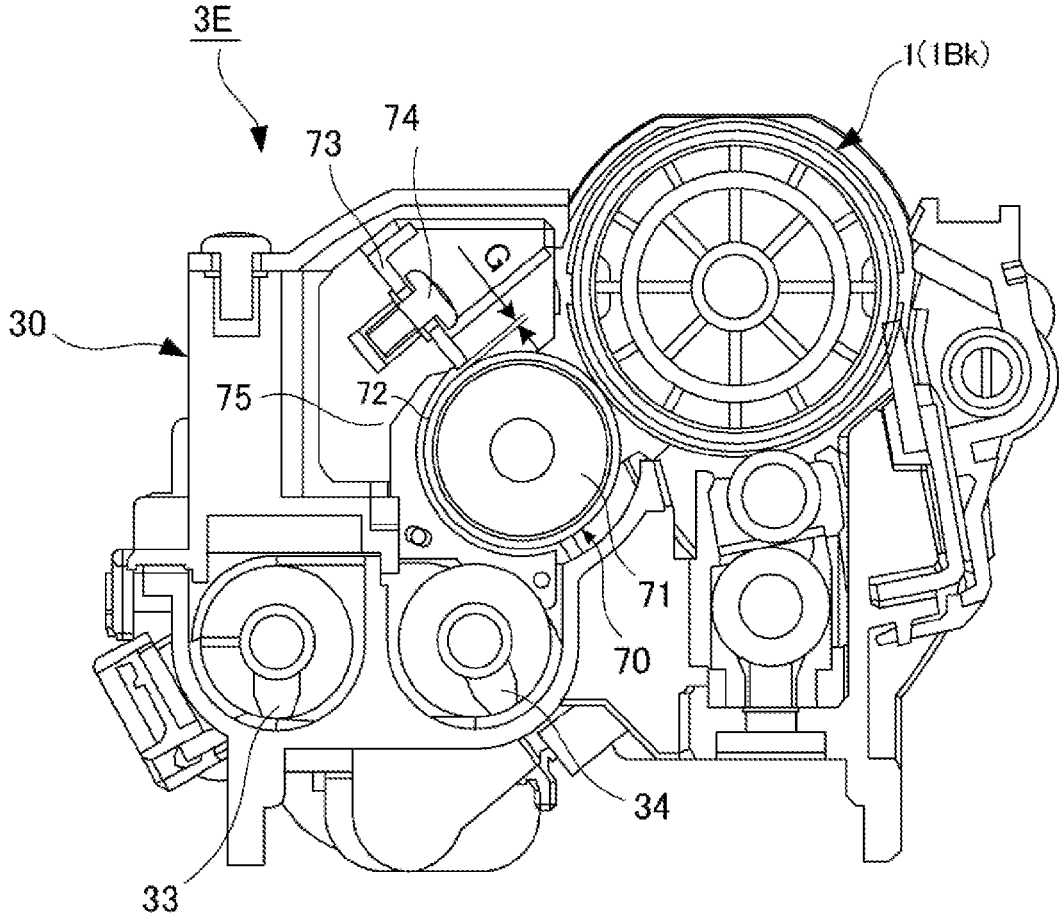
FIG. 5 is an illustration of structure for a developing device in Comparison Example 1.

FIG. 5 is an illustration of a structure of a developing device 3E in Comparison Example 1. The developing device 3E in Comparison Example 1 is similarly constituted as the developing device in Embodiment 1 except that the sleeve holder frame 37 shown in FIG. 2 is replaced with a layer thickness regulating blade 73 fixed to a developer rectifying member 75 shown in FIG. 5. Accordingly, in FIG. 5, constituent elements common to Embodiment 1 and Comparison Example 1 are represented by the same reference numerals or symbols as those in FIG. 2 and will be omitted from redundant description.

As shown in FIG. 5, in the developing device 3E in Comparison Example 1, the developer rectifying member 75 is supported by the developing container 30 at end portions thereof. The layer thickness regulating blade 73 is constituted by a stainless steel plate material and is fixed to the developer rectifying member 75 at a plurality of longitudinal positions by using screws 74. The layer thickness regulating blade 73 is disposed so that a free end portion thereof opposes the surface of the developing sleeve 70 to form the SB gap G between the free end portion and the surface of the developing sleeve 70. The erected chain-shaped developer carried on the developing sleeve 70 is uniformly cut in a process in which the developer passes through the SB gap G, so that a developer coating layer having a uniform thickness is formed on the surface of the developing sleeve 70.

In Comparison Example 1, adjustment such that the layer thickness regulating blade 73 is mounted on the developer rectifying member 75 so that the SB gap G satisfies predetermined accuracy over an entire area of the developing region of the developing sleeve 70 is troublesome compared with Embodiment 1. This is because a distribution of the SB gap G along the developing sleeve 70 changes every fastening of the plurality of screws 74.

In Comparison Example 1, when the layer thickness regulating blade 73 is deformed by a force generated at the time when the developer carried on the developing sleeve 70 passes through the SB gap G, the distribution of the SB gap G along the developing sleeve 70 becomes non-uniform. When the distribution of the SB gap G becomes non-uniform, a coating thickness of the developer carried on the developing sleeve 70 does not become uniform, so that a developer image causes density non-uniformity.

As described in JP-A 2002-214886, when the metal plate material of the layer thickness regulating blade 73 has a rib-like drawing shape with respect to the longitudinal direction, the geometrical moment of inertia against the force generated at the time when the developer passes through the SB gap G is increased, so that the deformation of the layer thickness regulating blade 73 can be prevented. However, a component cost of the layer thickness regulating blade 73 is increased, so that a total component cost cannot be reduced to the extent in Embodiment 1.

In recent years, weight reduction of the developing device is required, so that the metal material for the layer thickness regulating blade 73 is required to be replaced with the resin material. Further, by replacing the metal material for the layer thickness regulating blade 73 with the resin material, it is also possible to obviate a problem that the metal powder generated with abrasion of the layer thickness regulating blade 73 is included in the developer.

Comparison Example 2

Figure 6:
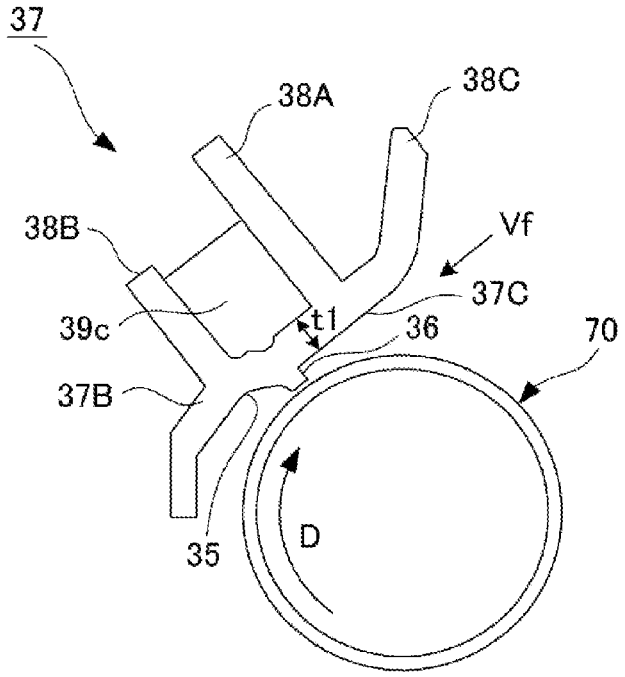
FIG. 6, (a) and (b) are illustrations showing a structure of a sleeve holder frame in Comparison Example 2.
Figure 6:
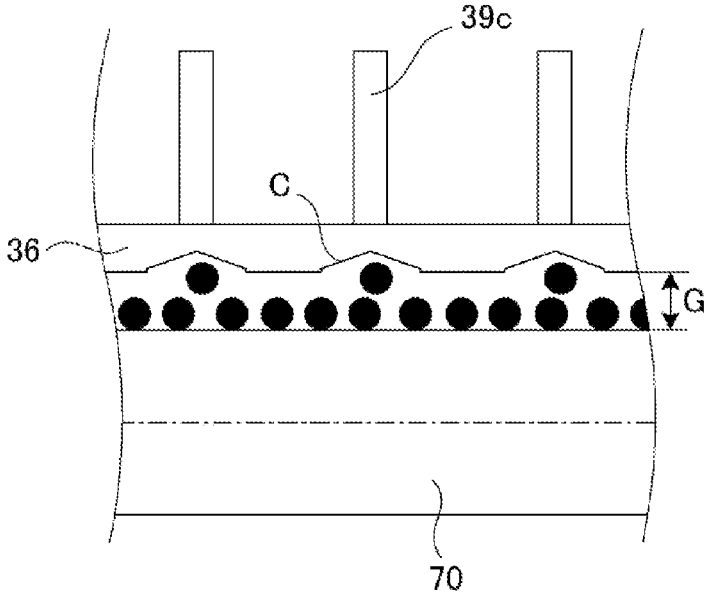

In FIG. 6, (a) and (b) are illustrations showing a structure of a sleeve holder frame in Comparison Example 2, in which (a) is sectional view in a cross section perpendicular to an axis of the developing sleeve, and (b) is the illustration of an arrangement of reinforcing ribs with respect to a feeding direction.

As shown in (a) of FIG. 6, the sleeve holder frame 37 is an injection-molded product, of a resin material, prepared by integrally constituting the layer thickness regulating portion 36, the developer rectifying portion 35 and the reinforcing ribs 38A, 38B and 39*c*. The sleeve holder frame 37 is prepared by connecting the reinforcing ribs 38A and 38B each extending in the rotational axis direction of the developing sleeve 70 shown in FIG. 4 and then by integrally molding the reinforcing ribs 38A and 38B with the plurality of reinforcing ribs 39*c* each extending in the feeding direction (the rotational direction D of the developing sleeve 70). A frame-like reinforcing structure is formed by connecting the reinforcing ribs 38A and 38B with the reinforcing ribs 39*c*, and thus rigidity against torsion of the sleeve holder frame 37 is considerably enhanced, so that it is possible to ensure sufficient rigidity against the force applied from the developer during the image formation.

As shown in (b) of FIG. 6, for reinforcing the sleeve holder frame 37, the reinforcing ribs 39*c* extending in the feeding direction are disposed no the back surface of the layer thickness regulating portion 36 so as to be perpendicular to the layer thickness regulating portion 36 defining the SB gap G with the developing sleeve 70. The reinforcing ribs 39*c* extending in the feeding direction are disposed at an interval of 60 mm along the developing region having a full length of 300 mm with respect to the rotational axis direction of the developing sleeve 70.

With respect to the sleeve holder frame 37 in Comparison Example 2, each of the reinforcing ribs 38A and 38B extending in the rotational axis direction of the developing sleeve 70 is 2 mm in thickness and 10 mm in height. On the other hand, each of the reinforcing ribs 39*c* extending in the feeding direction is 2 mm in thickness and 6 mm in height.

As shown in (b) of FIG. 6, with respect to the sleeve holder frame 37 in Comparison Example 2, at a position crossing each of the feeding direction reinforcing ribs 39*c*, a recess of 40 μm was generated at the surface of the layer thickness regulating portion 36. The recess results from sink of the resin material due to contraction at the time when the resin material is hardened in a metal mold after the injection molding. The layer thickness regulating portion 36 on which the recesses are formed partly makes the distribution of the SB gap with respect to the longitudinal direction of the developing sleeve 70 non-uniform, so that layer thickness non-uniformity of the developer carried on the developing sleeve 70 is generated, and thus density non-uniformity of an output image is generated with respect to a widthwise direction perpendicular to the feeding direction.

In each of the embodiments of the present application, an arrangement of reinforcing ribs corresponding to the feeding direction reinforcing ribs 39*c* is devised so as to eliminate the recesses of the layer thickness regulating portion 36 resulting from the feeding direction reinforcing ribs 39*c*.

(Reinforcing Rib in Embodiment 1)

As shown in FIG. 4, the reinforcing ribs 38A and 38B as an example of a rib portion are disposed on the cover portion 37C in the side opposite from the layer thickness regulating portion 36. The reinforcing rib 38A does not overlap with the layer thickness regulating portion 36 with respect to a direction in which the layer thickness regulating portion 36 projects from the cover portion 37C. The reinforcing ribs 38A and 38B are disposed so that the reinforcing ribs 38A and 38B are spaced, by a distance which is not less than two times a length of the layer thickness regulating portion 36 with respect to the rotational axis direction of the developer carrying member, from a position where the cover portion 37C overlaps with the layer thickness regulating portion 36 with respect to the direction in which the layer thickness regulating portion 36 projects from the cover portion 37C. That is, the rib portion is disposed at a non-overlapping position with a region at the back surface of the opposing portion, at least in the image forming region, corresponding to a region where the layer thickness regulating portion is formed. The region corresponding to the region where the layer thickness regulating portion is formed is a non-overlapping region as seen in a radial direction from a center line of the developer carrying member or a non-overlapping region when the rib portion projects, on a surface, in a thickness direction of the opposing portion. On the other hand, with respect to a circumferential direction of the developer carrying member, the region, at the back surface of the opposing portion, corresponding to the region where the layer thickness regulating portion is formed is a region corresponding to a region ranging from an entrance to an exit of the gap G. In other words, the region is an entire region, in the region in which layer thickness regulation is needed, where the layer thickness regulating portion is formed in a large thickness toward the developer carrying member.

In Embodiment 1, the feeding direction rib portions are disposed outside the developing region of the developing sleeve 70 but are not disposed inside the developing region of the developing sleeve 70. For this reason, on the layer thickness regulating portion in the developing region of the developing sleeve 70, the recesses resulting from the feeding direction reinforcing ribs are not formed.

As shown in FIG. 3, in Embodiment 1, on the surface of the sleeve holder frame 37 in the side opposite from the side where the layer thickness regulating portion 36 is disposed, the reinforcing ribs 38A and 38B extending in the rotational axis direction of the developing sleeve 70 are disposed. Further, the reinforcing ribs 38A and 38B are connected, by feeding direction reinforcing ribs 40 disposed outside the developing region of the developing sleeve 70, so as to cross the reinforcing ribs 40. The reinforcing ribs extending in the rotational axis direction of the developing sleeve 70 are connected, outside the reinforcing ribs 40, with connecting surface flanges 41, and also the connecting surface flanges 41 function as feeding direction reinforcing ribs for connecting (bridging) the reinforcing ribs 38A and 38B.

In Embodiment 1, end portions of each of the reinforcing ribs 38A and 38B extending in the rotational axis direction of the developing sleeve 70 are reinforced by the feeding direction reinforcing ribs 40 and the connecting surface flanges 41, and therefore, torsional rigidity of the sleeve holder frame 37 is enhanced. The above-described geometrical moment of inertia against the force acting on the layer thickness regulating portion 36 is partly increased, so that the reinforcement also contributes to enhancement of bending rigidity of the sleeve holder frame 37 as a whole.

In Embodiment 1, the feeding direction reinforcing ribs 40 are disposed outside the developing region, and therefore straightness of the layer thickness regulating portion 36 is not readily lowered locally by contraction of the resin material during the injection molding. For this reason, it is possible to mold the sleeve holder frame 37 while maintaining the straightness of the layer thickness regulating portion 36 with high accuracy.

In addition, in Embodiment 1, each of the reinforcing ribs 38A and 38B has a constant cross section at each of positions with respect to the rotational axis direction of the developing sleeve 70, and therefore warpage of the sleeve holder frame 37 as a whole due to the resin contraction during the injection molding is not readily generated. Each of the reinforcing ribs 38A and 38B has the constant cross section at each of the positions with respect to the rotational axis direction of the developing sleeve 70, and therefore the resin contraction during the injection molding uniformly generates along the layer thickness regulating portion 36. Further, each of the reinforcing ribs 38A and 38B is disposed at a position spaced from the back-side position of the layer thickness regulating portion 36 by a distance not less than two times the thickness of the layer thickness regulating portion 36, and therefore the resin contraction during the injection molding with respect to the reinforcing ribs 38A and 38B does not adversely affect the layer thickness regulating portion 36. For these reasons, in Embodiment 1, it is possible to perform the molding of the sleeve holder frame 37 while maintaining the straightness of the layer thickness regulating portion 36 with high accuracy.

(Effect of Embodiment 1)

In Embodiment 1, the layer thickness regulating member is provided with the rib portions provided integrally for ensuring the rigidity against the force applied from the developer during the developer layer thickness regulation. A principal shape of each of the rib portions is such that in a longitudinal layer thickness regulating region, at least in the neighborhood of the back surface of the developer layer thickness regulating portion, the rib portion extends in the longitudinal direction.

The layer thickness regulating member ensures the rigidity against the force applied from the developer during the developer layer thickness regulation by integrally providing the reinforcing ribs. A principal shape of each of the reinforcing ribs is such that in the longitudinal layer thickness regulating region, at least in the neighborhood of the back surface of the developer layer thickness regulating portion, the reinforcing rib extends in the longitudinal direction.

Accordingly, by the force generated during the regulation of the layer thickness of the developer, it is possible to prevent generation of density fluctuation caused by the deformation of the layer thickness regulating member. Even when the layer thickness regulating member is formed as the resin-molded product, there is a problem in terms of longitudinal straightness and thermal displacement of the layer thickness regulating portion.

According to Embodiment 1, the layer thickness regulating member is molded while maintaining straightness of the layer thickness regulating surface with high accuracy, and a degree of the deformation of the layer thickness regulating portion during the layer thickness regulation is reduced, so that a degree of the SB gap fluctuation can be reduced. By replacing the metal material-made layer thickness regulating member with the resin-molded product, it is possible to avoid inclusion of the metal powder, peeled off from the metal material, into the developer on the developing sleeve 70.

According to Embodiment 1, by using the layer thickness regulating member which is the resin-molded product having high accuracy and high rigidity, stable regulation of the amount of the developer on the developing sleeve can be realized by a simple and inexpensive constitution. By stably regulating the amount of the developer on the developing sleeve, it is possible to inexpensively provide the developing device, the process cartridge and the image forming apparatus which are capable of providing a stable developed image density.

Embodiment 2

Figure 7:
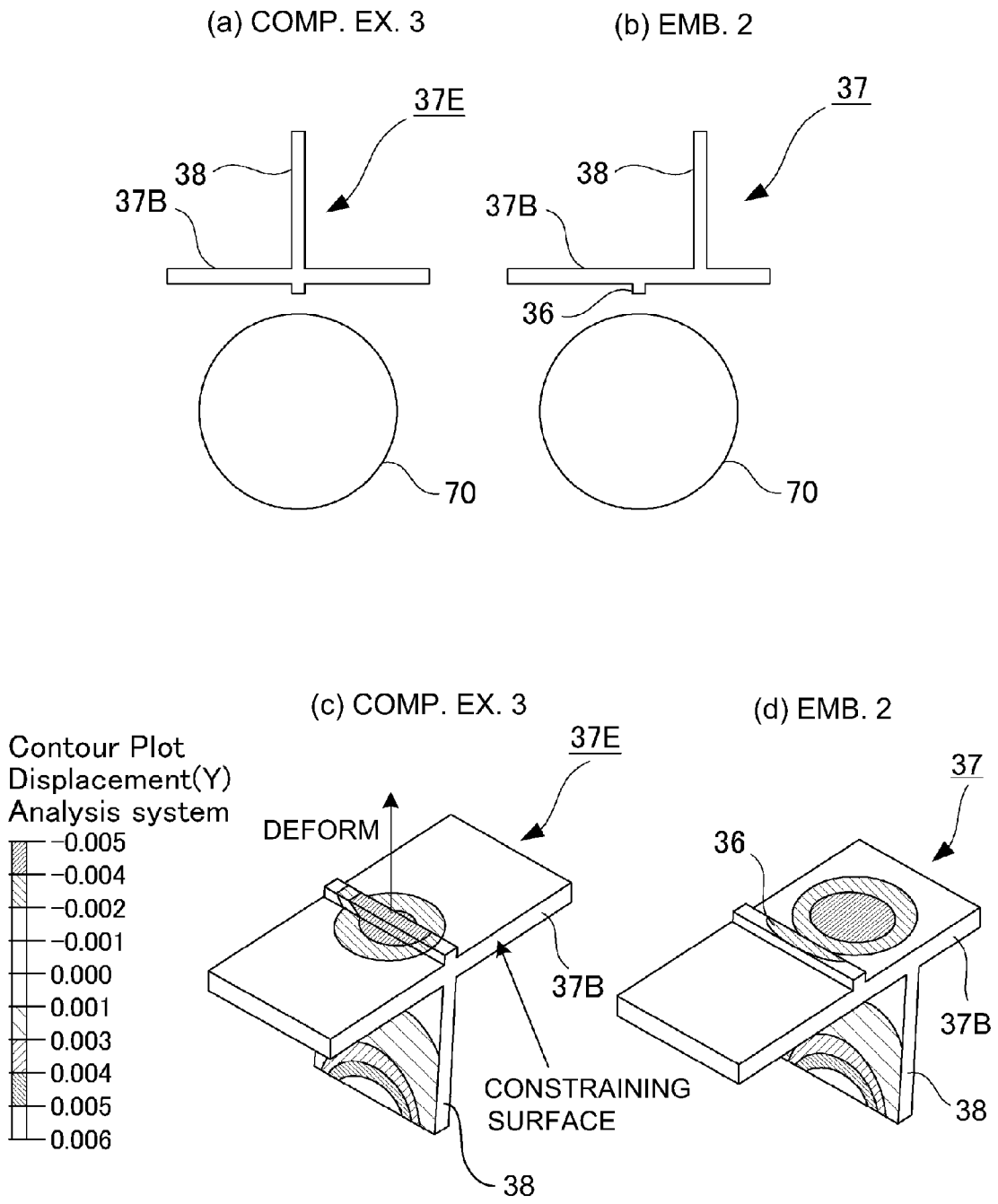
In FIG. 7, (a) and (c) are schematic views for illustrating thermal deformation of a layer thickness regulating portion in Comparison Example 3, and (b) and (d) are schematic views for illustrating thermal deformation of a layer thickness regulating portion in Embodiment 2.

In FIG. 7, (a) to (d) are schematic views for illustrating thermal deformation of a layer thickness regulating portion in Comparison Example 3 or Embodiment 2. Each of (a) to (d) of FIG. 7 shows a result of simulation of the thermal deformation of the layer thickness regulating portion (36) in the case where a certain temperature change is generated in the reinforcing rib 38 in a state in which end portions of the sleeve holder frame 37 having a T-shape in cross section are constrained. In FIG. 7, (a) shows Comparison Example 3 in which the reinforcing rib 38 is disposed in alignment with the layer thickness regulating portion 36 at a back-side position. In FIG. 7, (b) shows Embodiment 2 in which the reinforcing rib 38 is disposed at a position spaced from the back-side position of the layer thickness regulating portion 36 by a distance which is two times the thickness of the layer thickness regulating portion 36.

As described in Embodiment 1, by disposing the reinforcing ribs 38A and 38B at positions each spaced from the back-side position of the layer thickness regulating portion 36, the deformation of the layer thickness regulating portion 36 during the injection molding can be avoided. In Embodiment 2, description that the same constitution is also effective in alleviating the thermal deformation of the sleeve holder frame 37 with an operation of the developing device and stop of the operation will be described.

As shown in (a) and (b) of FIG. 7, heat is generated with the image formation, so that a local temperature rise is generated in the sleeve holder frame 37. The causes of the temperature rise are heat generated at bearing portions of rotation shafts of the developing sleeve 70 and the feeding screws 33 and 34 in the image forming process heat generated at the time when the developer passes through the SB gap G, and so on. In each of (c) and (d) of FIG. 7, hatched circular regions show amounts of displacement different by 1 μm for each of densities of portions of the hatching.

The layer thickness regulating portion 36 and the reinforcing rib 38 are integrally molded by the resin material which is low in thermal conductivity and is high in thermal expansion coefficient compared with the metal material, and therefore the sleeve holder frame 37 shows a temperature distribution, so that the displacement amount varies depending on the position.

In Comparison Example 3 shown in (a) of FIG. 7, the reinforcing rib 38 is disposed at the back-side position of the layer thickness regulating portion 36, and therefore thermal strain of the reinforcing rib 38 directly displaces the layer thickness regulating portion 36, thus influencing straightness of the layer thickness regulating portion 36. The thermal strain of a rib corresponding to the reinforcing rib 38 influences a portion corresponding to the layer thickness regulating portion 36, thus largely influencing a fluctuation of the SB gap G in which the fluctuation should be suppressed.

In Embodiment 2 shown in (b) of FIG. 7, the reinforcing rib 38 is disposed at a remote position from the back-side position of the layer thickness regulating portion 36, and therefore as shown in (d) of FIG. 7, the thermal strain of the reinforcing rib 38 little displaces the layer thickness regulating portion 36 and thus does not influence the straightness of the layer thickness regulating portion 36. In Embodiment 2, when a length of the layer thickness regulating portion 36 with respect to the feeding direction is T1, the reinforcing rib 38A was disposed at a position, spaced from an overlapping position with the layer thickness regulating portion 36, by a distance of 2×T1 in a downstream side with respect to the rotational direction of the developing sleeve 70. The reinforcing rib 38B was disposed at a position, spaced from the overlapping position with the layer thickness regulating portion 36, by a distance of 2×T1 in an upstream side with respect to the rotational direction of the developing sleeve 70. In addition, the beam having a length of 2×T1 is flexed to absorb the thermal strain of the reinforcing rib 38, and therefore the thermal strain of the reinforcing rib 38 little influences the layer thickness regulating portion 36. Accordingly, in the case where the layer thickness regulating portion 36 is molded with the resin material, it is desirable that the layer thickness regulating portion 36 and the reinforcing rib 38 are disposed at positions spaced from each other in the upstream side or the downstream side with respect to the rotational direction of the developing sleeve 70.

As shown in (b) of FIG. 7, the rib corresponding to the reinforcing rib 38 and the rib corresponding to the layer thickness regulating portion 36 are spaced from each other, so that a degree of the deformation of the layer thickness regulating portion 36 due to the thermal strain of the reinforcing rib 38 becomes small. As a result, it was turned out that compared with Comparison Example 3, in Embodiment 2, the influence of the thermal contraction can be improved by about 50%.

According to Embodiment 2, even when the layer thickness regulating portion 36 is a molded product of the resin material, it is possible to sufficiently ensure the rigidity, and even when a simple and inexpensive constitution is employed, a developed image density with respect to the longitudinal direction of the image region is not readily fluctuated.

Example 3

Figure 8:
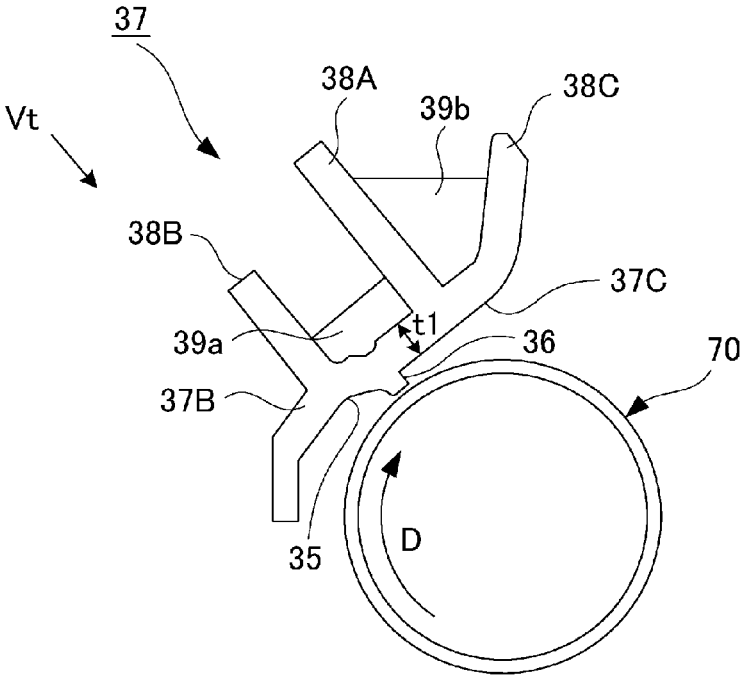
In FIG. 8, (a) and (b) are illustrations showing a structure of a sleeve holder frame in Embodiment 3.
Figure 8:
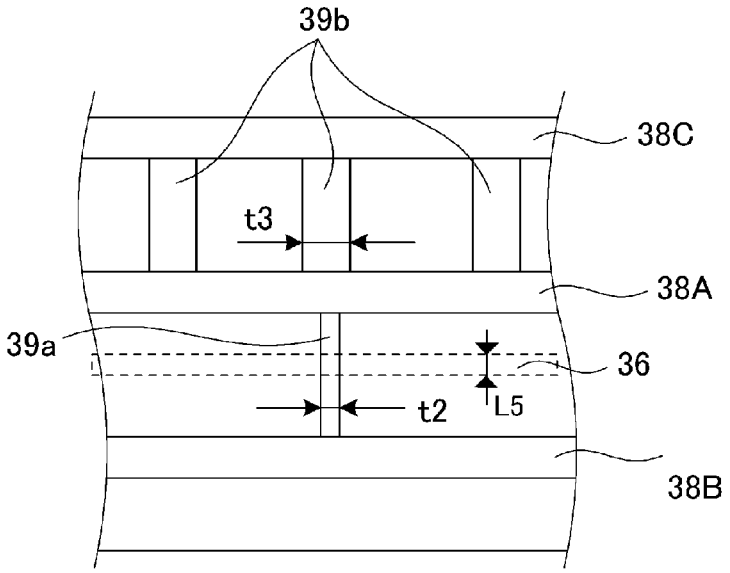

FIG. 8 is an illustration of a structure of a sleeve holder frame in Embodiment 3. In FIG. 8, (a) is a sectional view of the sleeve holder frame in cross section perpendicular to an axis of the developing sleeve 70, and (b) is an illustration of an arrangement of reinforcing ribs in a feeding direction. The sleeve holder frame 37 in Example 3 is similarly constituted as the sleeve holder frame 37 in Comparison Example 2 except that the thickness of feeding direction reinforcing ribs 39*c* shown in FIG. 6 is thin, and is mounted in the same developing device as the developing device in Embodiment 1. Accordingly, in FIG. 8, constituent elements common to Embodiment 3 and Comparison Example 2 are represented by the same reference numerals or symbols as those in FIG. 2 and will be omitted from redundant description.

As shown in FIG. 8, each of reinforcing ribs 38A and 38B as an example of a first rib portion is continuously provided with respect to a rotational axis direction of a developer carrying member (developing sleeve 70). The reinforcing ribs 38A and 38B are disposed at a cover portion 37C and a developer rectifying portion 35, respectively, between which an overlapping position with a layer thickness regulating portion 36 with respect to a direction in which the layer thickness regulating portion 36 projects is located.

A reinforcing rib 39*b* as an example of a second rib portion is provided with respect to a direction of the reinforcing ribs 38A and 38C, and connects the reinforcing ribs 38A and 38C. A reinforcing rib 39*a* as an example of the second rib portion has a thickness, at least at the overlapping position with the layer thickness regulating portion 36, which is ½ or less of a length of the layer thickness regulating portion 36 with respect to a rotational direction of the developer carrying member.

As shown in FIG. 3, the sleeve holder frame 37 in Embodiment 3 is provided with the reinforcing ribs 38A and 38B, extending in the rotational axis direction of the developing sleeve 70, disposed in a side opposite from the side where the layer thickness regulating portion 36 (FIG. 4) is disposed. The reinforcing ribs 38A and 38B are connected, at end portions of the sleeve holder frame 37, by the reinforcing ribs 40 and the connecting surface flanges 41, so that the bending rigidity and the torsional rigidity of the sleeve holder frame 37 as a whole are enhanced.

As shown in (a) of FIG. 8, in Embodiment 3, similarly as in Comparison Example 2, the feeding direction reinforcing rib 39*a* is disposed on the back surface of the layer thickness regulating portion 36 so as to cross the layer thickness regulating portion 36 defining the SB gap G with the developing sleeve 70. As shown in (b) of FIG. 8, the feeding direction reinforcing rib 39*a* is disposed at an interval of 60 mm along the developing region, of the developing sleeve 70, having a full length of 300 mm with respect to the rotational axis direction of the developing sleeve 70.

However, in Embodiment 3, when a length of the layer thickness regulating portion 36 with respect to the feeding direction is L5, the thickness of the feeding direction reinforcing rib 39*a* is t2 which is sufficiently thin compared with the length L5. Specifically, compared with the length L5=2 mm, the thickness t2 of the feeding direction reinforcing rib 39*a* was set at 0.5 mm.

By an experiment, in the case where the sleeve holder frame 37 shown in FIG. 3 was used in the developing device 3 shown in FIG. 2, it was confirmed that straightness of the layer thickness regulating portion was less than 30 μm when the thickness t2 of the reinforcing rib 39*a* was made less than ½ of the length L5 of the layer thickness regulating portion 36 with respect to the feeding direction. However, a value of the straightness was not determined by only the thickness of the reinforcing rib 39*a* but varied depending on also the resin material and an injection molding condition.

In Embodiment 3, the thickness t2 of the reinforcing rib 39*a* is thinner than the length of the layer thickness regulating portion 36 with respect to the feeding direction, and therefore a degree of the influence on a lowering in straightness of the layer thickness regulating portion 36 due to the resin contraction during the injection molding is small. In Embodiment 3, the thickness t2 of the reinforcing rib 39*a* is thinner than ½ of the length of the layer thickness regulating portion 36 with respect to the feeding direction, and therefore the degree of the influence on the lowering in straightness of the layer thickness regulating portion 36 due to the resin contraction during the injection molding is smaller. In Embodiment 3, the thickness t2 of the reinforcing rib 39*a* is ¼ or less of the length of the layer thickness regulating portion 36 with respect to the feeding direction, and therefore there is substantially no influence on the lowering in straightness of the layer thickness regulating portion 36 due to the resin contraction during the injection molding being smaller.

In the case where the thickness of the reinforcing rib is thin to the extent that there is no influence on the straightness of the layer thickness regulating portion 36, the feeding direction reinforcing rib 39*c* cannot constitute an effective reinforcing means alone, but by increasing an arrangement density of the feeding direction reinforcing rib compared with that in Comparison Example 2, it is possible to realize sufficient torsional rigidity and bending (flexural) rigidity as a whole.

Embodiment 4

In Comparison Example 2, the feeding direction reinforcing rib 39*c* was disposed at the partly overlapping position with the layer thickness regulating portion 36 in the side opposite from the side where the layer thickness regulating portion 36 of the sleeve holder frame 37 was disposed, and therefore, the lowering in straightness of the layer thickness regulating portion 36 was caused. Accordingly, even when a thick feeding direction reinforcing rib is disposed, if the feeding direction reinforcing rib is provided at a non-overlapping position with the layer thickness regulating portion 36 in the side opposite from the side where the layer thickness regulating portion 36 of the sleeve holder frame 37 is disposed, the thick feeding direction reinforcing rib does not cause the lowering in straightness of the layer thickness regulating portion 36.

As shown in (b) of FIG. 8, in Embodiment 4, as a reinforcing means for the sleeve holder frame 37, a plurality of feeding direction reinforcing ribs 39*b* individually connected with the reinforcing rib 38A are disposed at a remote position from the back surface of the layer thickness regulating portion 36. Each of the feeding direction reinforcing ribs 39*b* has a thickness which is two times the length L5 of the layer thickness regulating portion 36 with respect to the feeding direction, but is remote from the layer thickness regulating portion 36, and therefore the degree of the influence on the straightness of the layer thickness regulating portion 36 is small. Each of the feeding direction reinforcing rib 39*b* can be set to have a thickness which is not less than the length L5 of the layer thickness regulating portion 36 with respect to the feeding direction.

In Embodiment 4, distortional rigidity and bending rigidity of the sleeve holder frame 37 can be enhanced by providing the sleeve holder frame 37 with the reinforcing rib 39*a* with respect to the direction crossing the layer thickness regulating portion 36. Even when the sleeve holder frame 37 including the layer thickness regulating portion 36 is the molded product of the resin material, the reinforcing rib 39*a* extending in the direction crossing the layer thickness regulating portion 36 does not lower the straightness of the layer thickness regulating portion 36 while the reinforcing ribs 38A, 38B and 39*a* ensure sufficient bending rigidity and distortional rigidity.

Other Embodiment

The present invention can be carried out also in other embodiments in which a part or all of constituent elements in the above-described embodiments are replaced with alternative constituent elements thereof so long as the layer thickness regulating member is reinforced by using the reinforcing ribs. When the developing device and the process cartridge include the toner regulating member formed integrally with the layer thickness regulating portion, Embodiments 1 to 4 are capable of being carried out.

When the image forming apparatus includes such a developing device or a process cartridge, the developing device and the process cartridge of the present invention can be carried out irrespective of a monochromatic machine (image forming apparatus) and a color machine (image forming apparatus).

The image forming apparatus can be carried out irrespective of a difference between one-drum type and tandem type and a difference between intermediary transfer type and a recording material feeding member type. The image forming apparatus can also be carried out irrespective of the number of image bearing members, a charging type of the image bearing members, an electrostatic image forming type, a transfer type, and the like.

Further, in the above-described embodiments, only a principal portion relating to toner image formation and transfer is described, but the present invention can be carried out in image forming apparatuses, having various uses, such as printers, various printing machines, copying machines, facsimile machines, and multi-function machines, by adding necessary equipment, devices and casing structures.

The effects of Embodiments 1 to 4 are not limited to those with respect to the resin material, but may be similarly obtained even in the case where the layer thickness regulating member is formed by a molding process (e.g., die-casting) using a metal material.

In Embodiments 1 to 4, the case of the developing device is described as an example, but effects similar to those in Embodiments 1 to 4 can be obtained also in the case where the present invention is carried out in the process cartridge which is integrally assembled with the photosensitive drum or the like into an exchanging unit and which is detachably mountable to the image forming apparatus. Further, when the image forming apparatus includes the developing device or the process cartridge, the present invention is applicable irrespective of the monochromatic machine and the color machine.

In Embodiments 1 to 4, the rotational direction D of the developing sleeve 70 is set so as to be a counter direction to the rotational direction E of the photosensitive drum 1, but may also be set so as to be the same direction as the rotational direction E of the photosensitive drum 1.

The layer thickness regulating member of the present invention is not provided with the rib portion at the overlapping position with the layer thickness regulating portion of the opposing portion, and therefore sink generated when the material melted in the integral molding is solidified and contracted does not influence the layer thickness regulating portion spaced by the thickness of the opposing portion.

Accordingly, even when the opposing portion, the layer thickness regulating portion and the rib portion are integrally molded, the recesses due to the sink of the material are not generated in the layer thickness regulating portion, so that the developer carried on the developer carrying member does not cause partial increase in thickness resulting from the sinking.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 166636/2013 filed Aug. 9, 2013, which is hereby incorporated by reference.

What is claimed is:

1. A layer thickness regulating member for regulating an amount of a developer carried on a surface of a developer carrying member for developing a latent image, said layer thickness regulating member comprising:

a base portion;

a layer thickness regulating portion configured to regulate the amount of developer carried on the surface of the developer carrying member, said layer thickness regulating portion projecting from said base portion along a rotational axis direction of the developer carrying member in a front side of said base portion;

wherein said base portion includes an upstream base portion provided upstream of said layer thickness regulating portion with respect to the rotational direction of the developer carrying member and a downstream base portion provided downstream of said layer thickness regulating portion with respect to the rotational direction of the developer carrying member, wherein a cross-section of said base portion perpendicular to an axial direction of the developer carrying member is extended along a tangential direction of the developer carrying member at a position where said regulating portion and the developer carrying member are closest to each other; and a reinforcing rib portion provided on a rear side of said base portion and projecting from said base portion, said reinforcing rib portion including a first reinforcing rib which is continuously disposed with respect to a rotational axis direction of the developer carrying member and a second reinforcing rib which is disposed in a direction crossing said first reinforcing rib, wherein said base portion, said layer thickness regulating portion, and said reinforcing rib portion are integrally molded, and wherein said layer thickness regulating portion and said first reinforcing rib are provided at positions spaced from each other with respect to the tangential direction.

2. The layer thickness regulating member according to claim 1, wherein in the cross-section, said layer thickness regulating portion and said reinforcing rib portion are spaced from each other with respect to the tangential direction by at least two times a thickness of said layer thickness regulating portion.

3. The layer thickness regulating member according to claim 1, wherein said base portion, said layer thickness regulating portion, said first reinforcing rib portion, and said second reinforcing rib portion are integrally molded by injection molding using a non-magnetic resin material.

4. A developing device comprising:

the layer thickness regulating member according to claim 1;

the developer carrying member opposing said layer thickness regulating member at a peripheral surface thereof; and a pair of supporting portions for rotatably supporting ends of said developer carrying member and fixed to end portions of said layer thickness regulating member.

5. The developing device according to claim 4, wherein said pair of supporting portions are fixed to said end portions of said layer thickness regulating member after a gap between said layer thickness regulating portion and said developer carrying member is adjusted to a predetermined distance.

6. A process cartridge comprising:

the developing device according to claim 4;

an image bearing member configured to bear an electrostatic image to be developed into a toner image by said developing device; and a positioning structure configured to position said developer carrying member at a position spaced from said image bearing member by a predetermined gap.

7. The layer thickness regulating member according to claim 1, wherein at least in the developing region with respect to the rotational axis direction of the developer carrying member, when said first reinforcing rib portion is seen from the rotational axis direction of the developer carrying member, said first reinforcing rib portion is provided so as not to overlap with said layer thickness regulating portion with respect to a rotational direction of the developer carrying member.

8. The layer thickness regulating member according to claim 1, wherein said base portion, said layer thickness regulating portion, said first reinforcing rib portion, and said second reinforcing rib portion are formed of a resin material.

9. The layer thickness regulating member according to claim 1, further comprising a rectifying portion, connected with said layer thickness regulating portion in a front side of said base portion and in a side upstream of said layer thickness regulating portion with respect to a rotational direction of the developer carrying member, for rectifying the developer positioned upstream of said layer thickness regulating portion toward said layer thickness regulating portion, wherein said rectifying portion is integrally molded with said layer thickness regulating portion.

10. A layer thickness regulating member for regulating an amount of a developer carried on a surface of a developer carrying member for developing a latent image, said layer thickness regulating member comprising:

a base portion;

a layer thickness regulating portion for regulating the amount of developer carried on the surface of the developer carrying member, said layer thickness regulating portion projecting from said base portion along a rotational axis direction of the developer carrying member in a front side of said base portion;

a first reinforcing rib portion provided on a rear side of said base portion and projecting from said base portion and which is continuously disposed with respect to a rotational axis direction of the developer carrying member; and a second reinforcing rib portion which is provided on the rear side of said base portion and projecting from said base portion and which is disposed with respect to a direction crossing said first rib portion so as to be connected with said first reinforcing rib portion, wherein said base portion, said layer thickness regulating portion, said first reinforcing rib portion, and said second reinforcing rib portion are integrally molded, wherein at least in a developing region with respect to the rotational axis direction of the developer carrying member, when said second reinforcing rib portion is seen from the rotational axis direction of the developer carrying member, said second reinforcing rib portion includes an overlapping region with said layer thickness regulating portion with respect to a rotational direction of the developer carrying member and has a thickness less than ½ of a thickness of said layer thickness regulating portion.

11. The layer thickness regulating member according to claim 10, wherein at least in the developing region with respect to the rotational axis direction of the developer carrying member, when said first reinforcing rib portion is seen from the rotational axis direction of the developer carrying member, said first reinforcing rib portion is provided so as not to overlap with said layer thickness regulating portion with respect to a rotational direction of the developer carrying member.

* * * * *